US012704027B2

(12) United States Patent
Eitschberger

(10) Patent No.: US 12,704,027 B2
(45) Date of Patent: Aug. 11, 2026

(54) TANDEM SEAL ADAPTER FOR PERFORATING GUNS

(71) Applicant: DynaEnergetics Europe GmbH, Troisdorf (DE)

(72) Inventor: Christian Eitschberger, Munich (DE)

(73) Assignee: DynaEnergetics Europe GmbH, Troisdorf (DE)

( * ) Notice: Subject to any disclaimer, the term of this patent is extended or adjusted under 35 U.S.C. 154(b) by 0 days.

(21) Appl. No.: 19/244,909

(22) Filed: Jun. 20, 2025

(65) Prior Publication Data

US 2025/0314135 A1 Oct. 9, 2025

Related U.S. Application Data

(63) Continuation of application No. 18/654,731, filed on May 3, 2024, now Pat. No. 12,338,691.

(60) Provisional application No. 63/514,726, filed on Jul. 20, 2023, provisional application No. 63/500,540, filed on May 5, 2023.

(51) Int. Cl.

| | |
|---|---|
| ***E21B 43/11*** | (2006.01) |
| ***E21B 17/042*** | (2006.01) |
| *E21B 43/116* | (2006.01) |

(52) U.S. Cl.

CPC ..... *E21B 17/0426* (2013.01); *E21B 43/116* (2013.01)

(58) Field of Classification Search

CPC ..... E21B 43/11; E21B 43/116; E21B 43/117; E21B 43/1185; E21B 43/119; E21B 17/028; E21B 17/042; E21B 17/0423; E21B 17/0426

See application file for complete search history.

(56) References Cited

U.S. PATENT DOCUMENTS

| | | | | | |
|---|---|---|---|---|---|
| 3,010,396 | A * | 11/1961 | Coleman | F42D 1/05 | 175/4.55 |
| 4,493,374 | A * | 1/1985 | Magee, Jr. | E21B 23/06 | 166/383 |
| 4,577,895 | A * | 3/1986 | Castille | F16L 15/008 | 285/334 |
| 4,598,967 | A * | 7/1986 | White | H01R 13/523 | 439/339 |
| 5,027,708 | A * | 7/1991 | Gonzalez | E21B 43/1185 | 102/202.1 |
| 5,240,077 | A * | 8/1993 | Whitsitt | E21B 33/1295 | 166/383 |
| 8,534,367 | B2 * | 9/2013 | Carisella | E21B 23/0412 | 166/381 |
| 9,970,576 | B2 * | 5/2018 | Williamson | E21B 17/042 | |
| 11,828,115 | B1 * | 11/2023 | Thomas | E21B 17/1085 | |
| 2020/0256166 | A1 * | 8/2020 | Knight | F42D 1/05 | |
| 2020/0332630 | A1 * | 10/2020 | Davis | E21B 23/04 | |
| 2021/0301599 | A1 * | 9/2021 | Mulhern | E21B 17/028 | |
| 2022/0325586 | A1 * | 10/2022 | Kash | E21B 43/119 | |

* cited by examiner

*Primary Examiner* — Kipp C Wallace

(74) *Attorney, Agent, or Firm* — Womble Bond Dickinson (US) LLP

(57) ABSTRACT

A tandem seal adapter for connecting first and second wellbore tools includes a body portion. The body portion has a first seal at a first end portion thereof, and a second seal at a second end portion thereof. The body portion includes a maximum outer diameter that is less than a maximum inner diameter of a mating portion of the first or second wellbore tool.

20 Claims, 10 Drawing Sheets

TANDEM SEAL ADAPTER FOR PERFORATING GUNS

CROSS-REFERENCE TO RELATED APPLICATION

This application is a Continuation application of and claims priority to U.S. patent application Ser. No. 18/654,731 filed May 3, 2024, which claims the benefit of and priority to U.S. Provisional Patent Application No. 63/500,540 filed May 5, 2023 and U.S. Provisional Patent Application No. 63/514,726 filed Jul. 20, 2023, the entirety of each of which is incorporated herein by reference.

FIELD OF DISCLOSURE

This disclosure relates generally to perforating guns and more particularly to tandem seal adapters for perforating guns.

BACKGROUND OF THE DISCLOSURE

Wellbore tools used in oil and gas operations, including perforating guns housing shaped charges, or similar operating explosive or mechanical devices, are often sent down a wellbore in tool strings connected together to reduce time and costs associated with the operation. Sub-assemblies connect adjacent wellbore tools to one another to form the tool string. Devices used to connect two adjacent wellbore tools may be tandem subs or tandem seal adapters.

There is a need for a tandem seal adapter that is less expensive and more efficient to manufacture and makes connecting two adjacent wellbore tools more efficient.

BRIEF DESCRIPTION

According to aspects of the present disclosure, the exemplary embodiments include a tandem seal adapter for connecting a first wellbore tool and a second wellbore tool. The tandem seal adapter may include a body portion with a first and second end. The body portion may include an outer surface extending between the first end and the second end. The outer surface may include a first threaded portion configured to engage a first screw thread of the first wellbore tool, a first sealing portion configured to create a first seal with the first wellbore tool, a second threaded portion configured to engage a second screw thread of the second wellbore tool, and a second sealing portion configured to create a second seal with the second wellbore tool. Further, a maximum outer diameter of the body portion may be less than a maximum inner diameter of a mating portion of the first or second wellbore tool.

According to further aspects of the present disclosure, the exemplary embodiments include a tandem seal adapter for connecting a first wellbore tool and a second wellbore tool. The tandem seal adapter may include a body portion with a first and second end. The body portion may include an outer surface extending between the first end and the second end. The outer surface may include a first threaded portion configured to engage a first screw thread of the first wellbore tool, a first sealing portion located between the first end of the body portion and the first threaded portion and configured to create a first seal with the first wellbore tool, a second threaded portion configured to engage a second screw thread of the second wellbore tool, and a second sealing portion located between the first threaded portion and the second threaded portion and configured to create a second seal with the second wellbore tool.

According to further aspects of the present disclosure, the exemplary embodiments include a tandem seal adapter for connecting a first wellbore tool and a second wellbore tool. The tandem seal adapter includes a body portion, a first seal, and a second seal. The body portion includes a first end portion, a second end portion, and an outer surface extending along a length of the body portion between the first end portion and the second end portion. The outer surface has an uninterrupted screw thread configured for engaging a first screw thread of the first wellbore tool and a second screw thread of the second wellbore tool. The first seal is disposed on the first end portion of the body portion, and the second seal is disposed on the second end portion of the body portion.

According to further aspects of the present disclosure, the exemplary embodiments include a perforating gun string including a first wellbore tool, a second wellbore tool, and a tandem seal adapter. The tandem seal adapter includes a first end portion, a second end portion, a pair of opposed keyways configured for engaging a correspondingly shaped pair of opposed keys of a rotary tool, and an outer surface extending between the first end portion and the second end portion. The outer surface has an uninterrupted screw thread configured to engage a first screw thread of the first wellbore tool and a second screw thread of the second wellbore tool.

According to further aspects of the present disclosure, the exemplary embodiments include a method of connecting a first wellbore tool and a second wellbore tool to one another. The method includes: threadedly engaging a first end portion of an uninterrupted screw thread of a tandem seal adapter on a threaded inner surface of the first wellbore tool; rotating the tandem seal adapter relative to the first wellbore tool, whereby the first wellbore tool moves axially along the uninterrupted screw thread of the tandem seal adapter; threadedly engaging a second end portion of the uninterrupted screw thread of the tandem seal adapter on a threaded inner surface of the second wellbore tool; and rotating the second wellbore tool relative to the tandem seal adapter or rotating the tandem seal adapter and the attached first wellbore tool relative to the second wellbore tool, whereby the second wellbore tool moves axially along the uninterrupted screw thread of the tandem seal adapter.

According to further aspects of the present disclosure, the exemplary embodiments include a tandem seal adapter for connecting a first wellbore tool and a second wellbore tool. The tandem seal adapter includes a first end portion configured to couple to the first wellbore tool, a second end portion configured to couple to the second wellbore tool, a pair of opposed keyways configured for engaging a correspondingly shaped pair of opposed keys of a rotary tool, and an outer surface extending between the first end portion and the second end portion. The outer surface has an uninterrupted screw thread configured to engage a first screw thread of the first wellbore tool and a second screw thread of the second wellbore tool.

BRIEF DESCRIPTION OF THE DRAWINGS

A more particular description will be rendered by reference to exemplary embodiments that are illustrated in the accompanying figures. Understanding that these drawings depict exemplary embodiments and do not limit the scope of this disclosure, the exemplary embodiments will be described and explained with additional specificity and detail through the use of the accompanying drawings in which.

Figure 1:
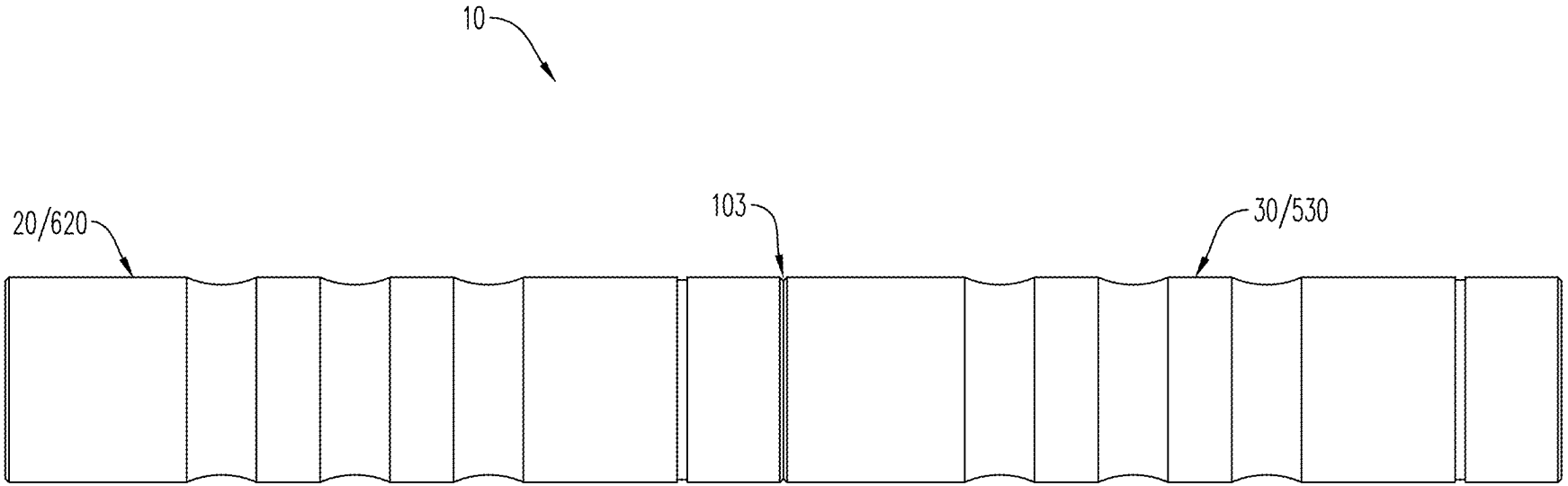
FIG. 1 is a side view illustrating an exemplary embodiment of a perforating gun system including a first wellbore tool coupled to a second wellbore tool via a tandem seal adapter.

Various features, aspects, and advantages of the exemplary embodiments will become more apparent from the following detailed description, along with the accompanying drawings in which like numerals represent like components throughout the figures and detailed description. The various described features are not necessarily drawn to scale in the drawings but are drawn to emphasize specific features relevant to some embodiments.

The headings used herein are for organizational purposes only and are not meant to limit the scope of the disclosure or the claims. To facilitate understanding, reference numerals have been used, where possible, to designate like elements common to the figures.

DETAILED DESCRIPTION

Reference will now be made in detail to various embodiments. Each example is provided by way of explanation and is not meant as a limitation and does not constitute a definition of all possible embodiments.

The term "coupled," as used herein, is defined as directly or indirectly connected or monolithically formed. Objects described herein as being "adjacent to" each other may be in physical contact with each other, in close proximity to each other, or in the same general region or area as each other, as appropriate for the context in which the phrase is used. Occurrences of the phrase "in one embodiment," or "in one aspect," herein do not necessarily all refer to the same embodiment or aspect.

Embodiments described herein relate generally to wellbore tools and perforating guns for use in a wellbore environment. For purposes of this disclosure, the phrases "devices," "systems," and "methods" may be used either individually or in any combination referring without limitation to disclosed components, grouping, arrangements, steps, functions, or processes.

For purposes of illustrating features of the embodiments, an exemplary embodiment will now be introduced and referenced throughout the disclosure. This example is illustrative and not limiting and is provided for illustrating the exemplary features of an alignment sub as described throughout this disclosure.

Current tandem subs for wellbore tools (e.g., perforating guns) and their variant tandem seal adapters (TSAs) have certain design characteristics in common. This includes a non-threaded outer surface section which functions Isas a gripping surface to tighten the connection, and two threaded surfaces adjacent either side of the non-threaded outer surface section to connect the TSA to a wellbore tool on each end of the TSA.

This disclosure describes tandem seal adapters having a maximum outer diameter that is less than a maximum inner diameter of mating portions of wellbore tools coupled thereby. Accordingly, the tandem seal adapters may be located internal to the first and second wellbore tools when assembled together, saving length in the overall downhole tool string. Further, the tandem seal adapters may include keyways configured for receipt of a pair of respective keys of a rotary tool for expediting assembly. For example, to connect two wellbore tools to each other, the TSA of the present disclosure is screwed into the first wellbore tool with the help of a key, which engages on an internal keyway of the TSA. The second wellbore tool is then attached to the TSA on the other side, by applying torque on the outer surfaces of both attached wellbore tools. In some embodiments, the present disclosure provides a TSA having an uninterrupted threading on an outer surface thereof on which both adjacent wellbore tools are connected. The TSA of the present disclosure, for example, reduces production costs, as the uninterrupted threads are easy to manufacture and eliminates some working steps compared to the current conventional designs, as well as saving length in the overall downhole tool string.

Turning now to FIGS. 1-8, the present disclosure provides exemplary embodiments of a wellbore tool connector or tandem seal adapter 100, 500 (FIG. 2, FIG. 5) for coupling a first wellbore tool 20, 620 (FIGS. 1, 3, 4, and 6), such as, for example, a first perforating gun, to a second wellbore tool 30, 630 (FIGS. 1, 4, and 6), such as, for example, a second perforating gun of a perforating gun system 10 (FIG. 1). As discussed in more detail below, generally, the tandem seal adapters 100, 500 may include a maximum outer diameter that is less than a maximum inner diameter of mating portions of the well bore tools coupled thereby. Accordingly, the tandem seal adapters 100, 500 may be located internal to the first and second wellbore tools when assembled together, saving length in the overall downhole tool string. Further, the tandem seal adapters 100, 500 may include keyways configured for receipt of a pair of respective keys of a rotary tool for expediting assembly.

Figure 2:
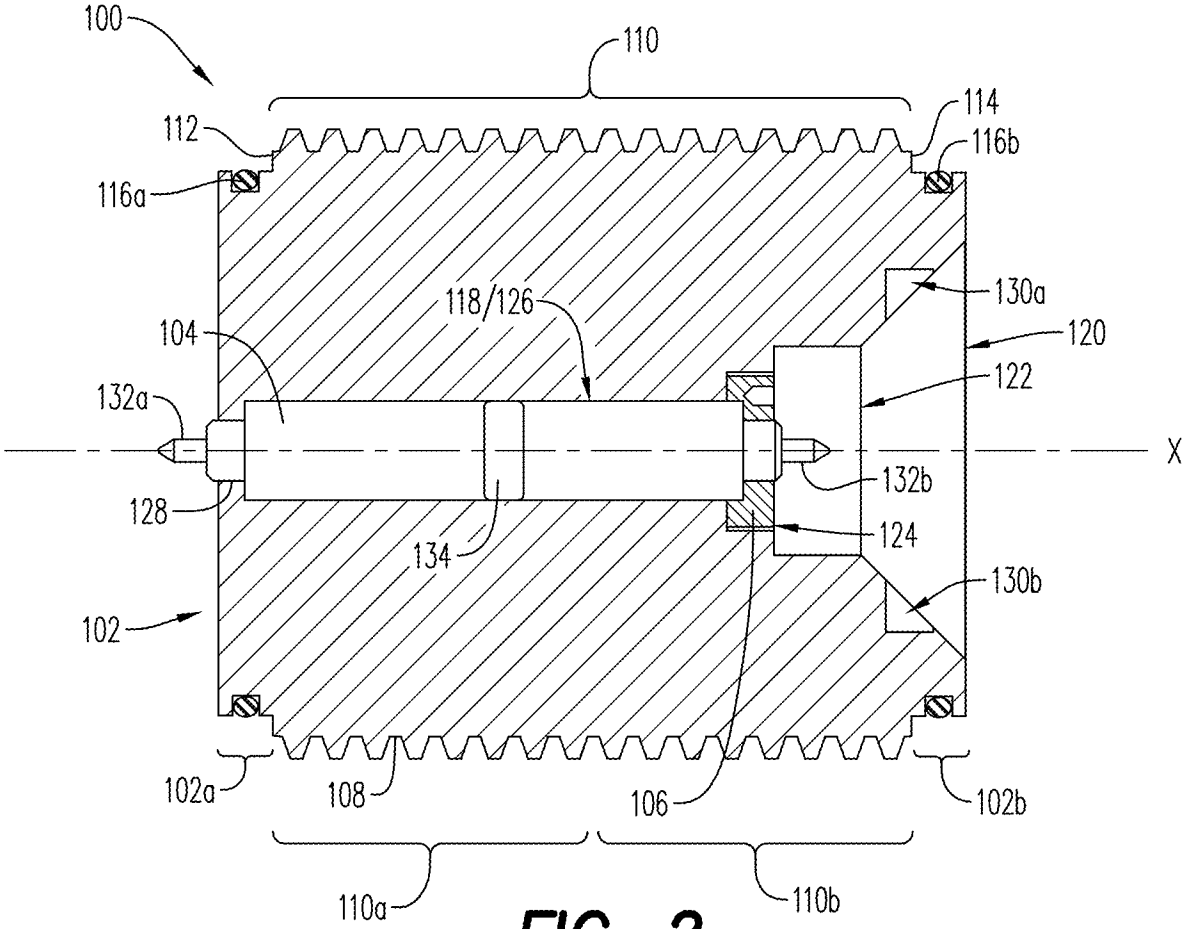
FIG. 2 is a longitudinal cross-sectional view of a first exemplary embodiment of the tandem seal adapter for coupling a first wellbore tool to a second wellbore tool.

Referring to FIG. 2, the tandem seal adapter 100 may be an assembly that includes a body portion 102, a bulkhead 104 supported in the body portion 102, and a retainer nut 106 for retaining the bulkhead 104 in the body portion 102. The body portion 102 may have a generally cylindrical shape and includes a first end portion 102*a*, a second end portion 102*b*, and an annular outer surface 108 extending therebetween (e.g., along the entire length of the body portion 102 or from the first end portion 102*a* to the second end portion 102*b*).

Each of the first and second end portions 102*a*, 102*b* of the body portion 102 have a non-threaded (e.g., devoid of a screw thread) outer sealing surface in which an annular recess is defined. The annular recess accommodates a respective seal 116*a*, 116*b* (e.g., an O-ring or elastomeric component) configured to prevent wellbore fluids from passing axially between an inner surface of the first wellbore tool 20 and the second wellbore tool 30 and the outer surface 108 of the body portion 102. Thus, in various embodiments, at least a portion of the seal 116*a* may be disposed in the annular recess of the first end portion 102*a* and at least a portion of the seal 116*b* may be disposed in the annular recess of the second end portion 102*b*. In various such embodiments, the first end portion 102*a* may be referred to as a first sealing portion and the second end portion 102*b* may be referred to as a second sealing portion. Further, the first sealing portion may be configured to create a first seal with the first wellbore tool 20 and the second sealing portion may be configured to create a second seal with the second wellbore tool 30.

The outer surface 108 of the body portion 102 has a screw thread 110 that extends uninterrupted between the first and second end portions 102*a*, 102*b* of the body portion 102. For example, the screw thread 110 extends along a length of the outer surface 108 between a first end portion 110*a* of the screw thread 110 and a second end portion 110*b* of the screw thread 110 without a break in threading. In addition, the screw thread 110 may be a uniform screw thread along the length of the outer surface 108. In other embodiments, one or more characteristics of the screw thread 110 (e.g., major diameter, minor diameter, pitch, thread angle, and the like) may change between the first end portion 110*a* and the second end portion 110*b*. The screw thread 110 has the first end portion 110*a* positioned adjacent the first end portion 102*a* of the body portion 102 and the second end portion 110*b* positioned adjacent the second end portion 102*b* of the body portion 102. The first end portion 110*a* of the screw thread 110 may be configured to threadedly couple to a corresponding threaded inner surface 34 of the first wellbore tool 20, and the second end portion 110*b* of the screw thread 110 may be configured to threadedly couple to a corresponding threaded inner surface 36 of the second wellbore tool 30. The uninterrupted screw thread 110 saves production costs, as the uninterrupted screw thread 110 is easy to manufacture and saves some working steps compared to current TSAs/Tandem Sub designs, as well as saving length in the overall downhole tool string.

The outer surface 108 of the body portion 102 has a first shoulder or stepped portion 112 that connects the first end portion 110*a* of the screw thread 110 to the first end portion 102*a* of the body portion 102, and a second shoulder or stepped portion 114 that connects the second end portion 110*b* of the screw thread 110 to the second end portion 102*b* of the body portion 102. The first stepped portion 112 is configured to abut a corresponding first shoulder 38 of the first wellbore tool 20, and the second stepped portion 114 is configured to abut a corresponding second shoulder 40 of the second wellbore tool 30 when the first and second wellbore tools 20, 30 are secured to the screw thread 110. Therefore, the stepped portions 112, 114 of the tandem seal adapter 100 indicate to an operator that the wellbore tools 20, 30 are properly secured to the tandem seal adapter 100.

Figure 4:
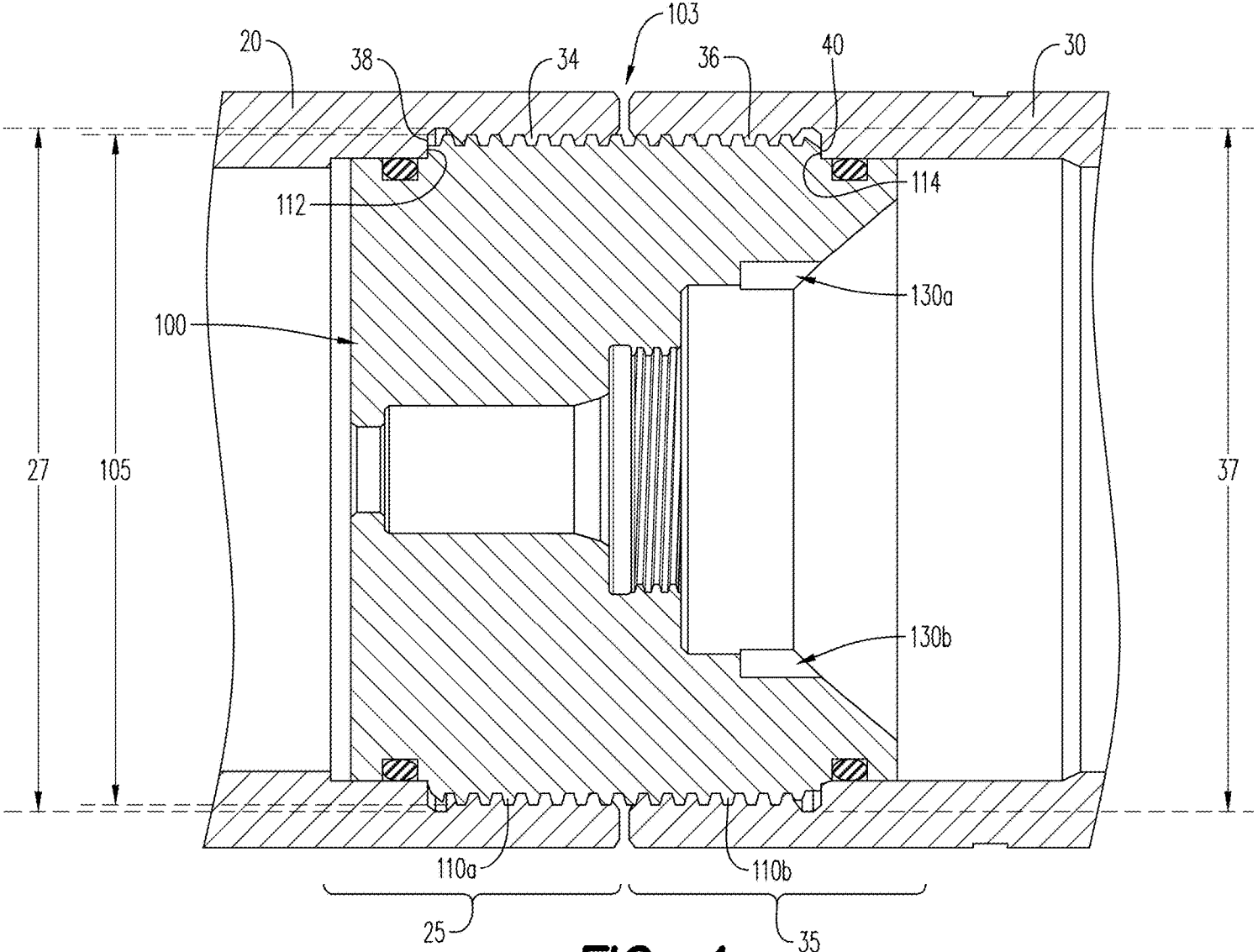
FIG. 4 is a longitudinal cross-sectional view of the tandem seal adapter of FIG. 2 coupled to a first wellbore tool and a second wellbore tool.

As shown in FIG. 4, the first wellbore tool 20 includes a mating portion 25 configured to engage with the TSA 100 when the first wellbore tool 20 is coupled to the TSA 100. Accordingly, the mating portion 25 of the first wellbore tool 20 may include the threaded inner surface 34 and the shoulder 38. Further, the mating portion 25 of the first wellbore tool 20 includes a maximum inner diameter 27 that is greater than a maximum outer diameter 105 of the TSA 100. Similarly, the second wellbore tool 30 includes a mating portion 35 configured to engage with the TSA 100 when the second wellbore tool 30 is coupled to the TSA 100. Accordingly, the mating portion 35 of the second wellbore tool 30 may include the threaded inner surface 36 and the shoulder 40. Further, the mating portion 35 of the second wellbore tool 30 includes a maximum inner diameter 37 that is greater than the maximum outer diameter 105 of the TSA 100.

The body portion 102 may define a bore 118 therethrough in which the bulkhead 104 is supported. The bore 118 may extend along a central longitudinal axis "x-x" of the body portion 102 or may be offset from the central longitudinal axis "x-x." The bore 118 may allow for a signal transfer, like an electrical feedthrough or a ballistic transfer, through the tandem seal adapter 100. The ballistic transfer may be an explosive booster or a detonating cord, or a combination of both, for transferring the ballistic signal received from the first wellbore tool 20 to the second wellbore tool 30. In aspects, the feedthrough hosted within the bore 118 may be the conductive bulkhead 104 that maintains sealing between the interiors of the first wellbore tool 20 and the second wellbore tool 30.

To this end, the bulkhead 104 may include a first pin 132*a* and a second pin 132*b* configured to establish electrical contact with a first wellbore tool and a second wellbore tool, respectively. In various embodiments, the first and second pins 132*a*, 132*b* may be biased, such as via a spring. In various such embodiments, the first and second pins 132*a*, 132*b* may be at least partially depressed into the bulkhead 104 when brought into contact with first and second wellbore tools, respectively (see e.g., FIG. 4). Biasing of the first and second pins 132*a*, 132*b* may ensure reliable contact between the bulkhead 104 and first and second wellbore tools. In many embodiments, contact between the bulkhead 104 and first and second wellbore tools may be utilized to pass electrical signals between the first and second wellbore tools. Accordingly, the bulkhead may be configured to communicatively couple the first wellbore tool 20 and the second wellbore tool 30. For example, electronic communication signals may be passed between the first wellbore tool 20 and the second wellbore tool 30 via the bulkhead 104 Additionally, the bulkhead 104 may include a seal 134 configured to prevent or resist pressure changes from propagating through the bore 118. Accordingly, the bulkhead 104 may be utilized, at least in part, to maintain pressure isolation between the first wellbore tool 20 and the second wellbore tool 30.

The bore 118 of the body portion 102 has a conical end portion 120, a first cylindrical portion 122 extending axially from the conical end portion 120 toward a center of the body portion 102, and a second cylindrical portion 124 extending axially from the first cylindrical portion 122. The second cylindrical portion 124 may have a smaller diameter than the first cylindrical portion 122 and is configured for receipt of the retainer nut 106 that secures the bulkhead 104 in the bore 118. The bore 118 further includes a main portion 126 extending axially between the first end portion 102*a* of the body portion 102 and the second cylindrical portion 124. The main portion 126 may have a smaller diameter than the second cylindrical portion 124 and is configured to accommodate the bulkhead 104 therein. In various embodiments, the bore 118 may further include an end portion 128 extending axially between the main portion 126 and the first end of the body portion 102. The end portion 128 may have a smaller diameter than the main portion 126 and prevent the bulkhead 104 from moving away from the conical end portion 120 when the bulkhead 104 is secured in the bore 118.

Figure 9:
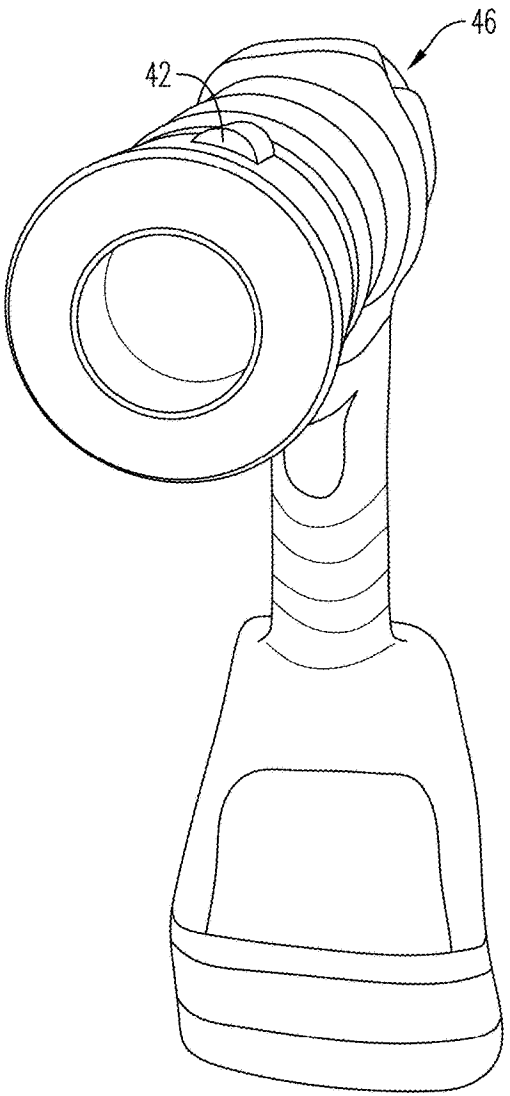
FIG. 9 is a perspective view illustrating a rotary hand tool for rotating the tandem seal adapter of FIG. 2 or FIG. 5.
Figure 8:
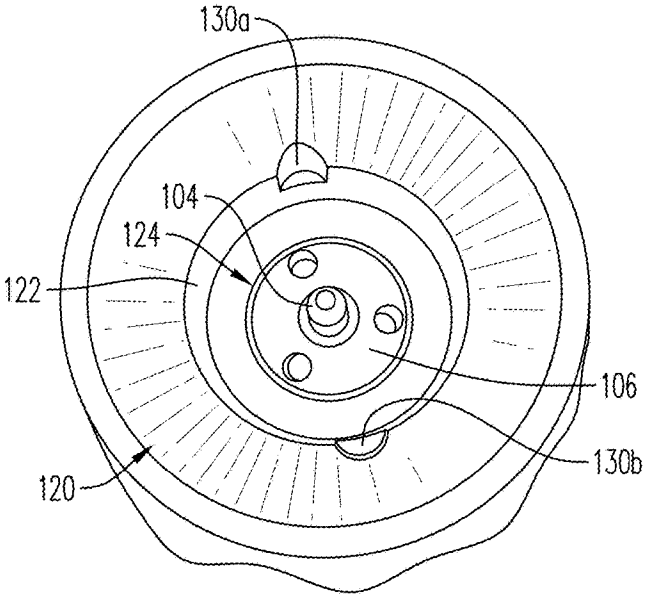
FIG. 8 is an end view of the tandem seal adapter of FIG. 2 or FIG. 5 with a bulkhead received therein.
Figure 7:
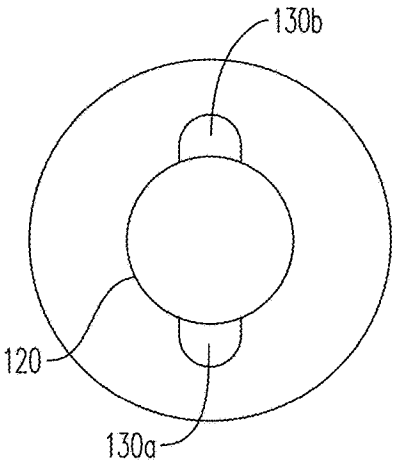
FIG. 7 is a schematic, end view of the tandem seal adapter of FIG. 2 or FIG. 5.

The second end portion 102*b* of the body portion 102 may define a pair of opposed recesses or keyways 130*a*, 130*b* that extend radially outward from the conical end portion 120 of the bore 118. As discussed in more detail below, the keyways 130*a*, 130*b* may have a semicircular shape corresponding to a pair of respective keys 42 on a power tool, such as, for example, a hand-operated rotary power tool 46 (see e.g., FIG. 9). In aspects, the keyways 130*a*, 130*b* and the keys 42 may assume any suitable shape.

Figure 5:
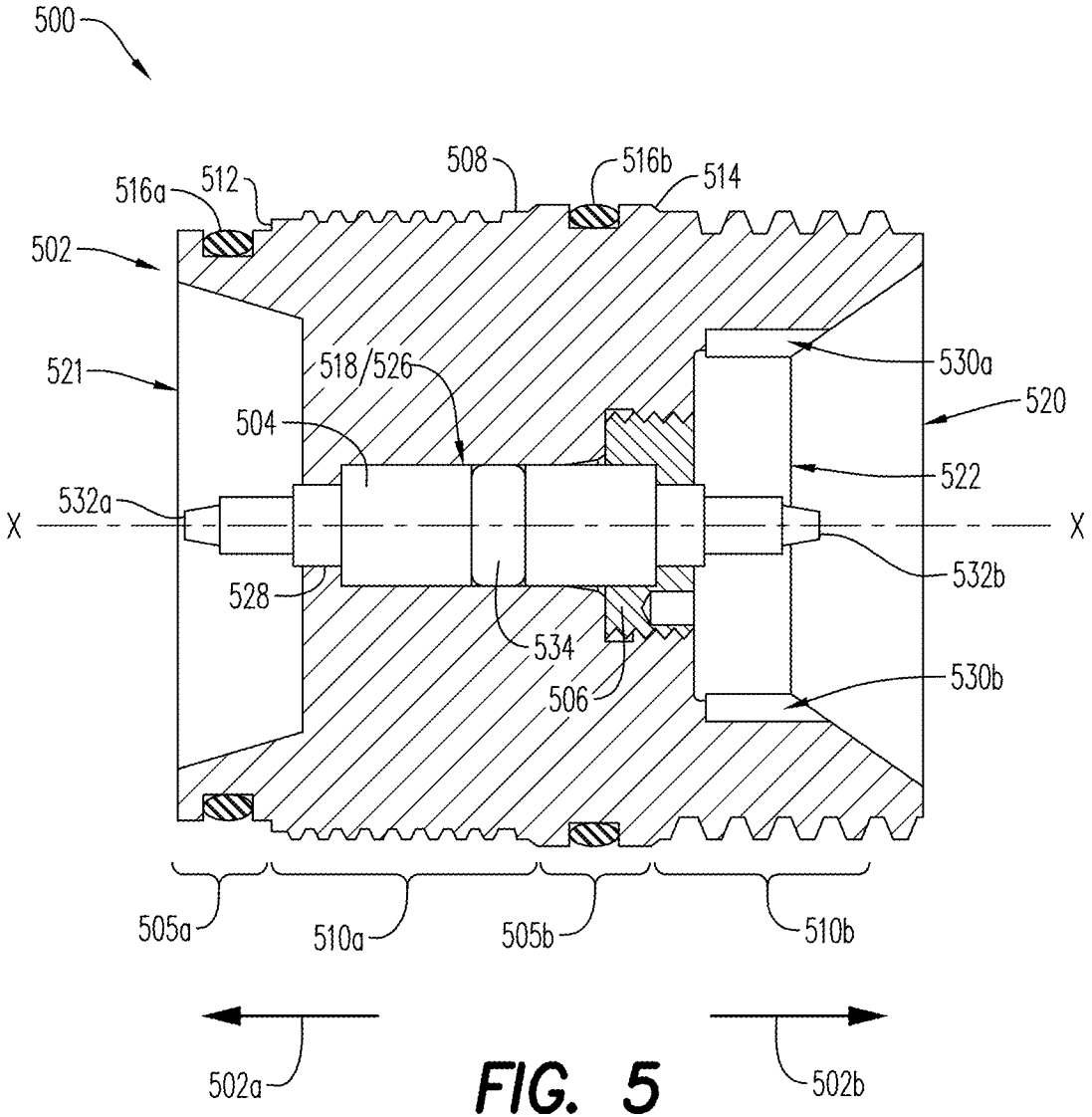
FIG. 5 is a longitudinal cross-sectional view of a second exemplary embodiment of the tandem seal adapter for coupling a first wellbore tool to a second wellbore tool.

FIG. 5 illustrates another embodiment of a tandem seal adapter 500. Some aspects/components of the tandem seal adapter 500 may be similar to aspects/components of tandem seal adapter 100. Accordingly, discussion of similar aspects/components of tandem seal adapter 500 may not be repeated. The tandem seal adapter 500 may be an assembly that includes a body portion 502, a bulkhead 504 supported in the body portion 502, and a retainer nut 506 for retaining the bulkhead 504 in the body portion 502. The body portion 502 may have a generally cylindrical shape and includes a first end 502*a*, a second end 502*b*, and an annular outer surface 508 extending therebetween (e.g., along the entire length of the body portion 502). The outer surface 508 may include a first sealing portion 505*a*, a second sealing portion 505*b*, a first threaded portion 510*a*, and a second threaded portion 510*b*. The first sealing portion 505*a* may be located between the first end 502*a* and the first threaded portion 510*a*. The first threaded portion 510*a* may be located between the first sealing portion 505*a* and the second sealing portion 505*b*. The second sealing portion 505*b* may be located between the first threaded portion 510*a* and the second threaded portion 510*b*. The second threaded portion 510*b* may be located between the second sealing portion 505*b* and the second end 502*a*.

Figure 6:
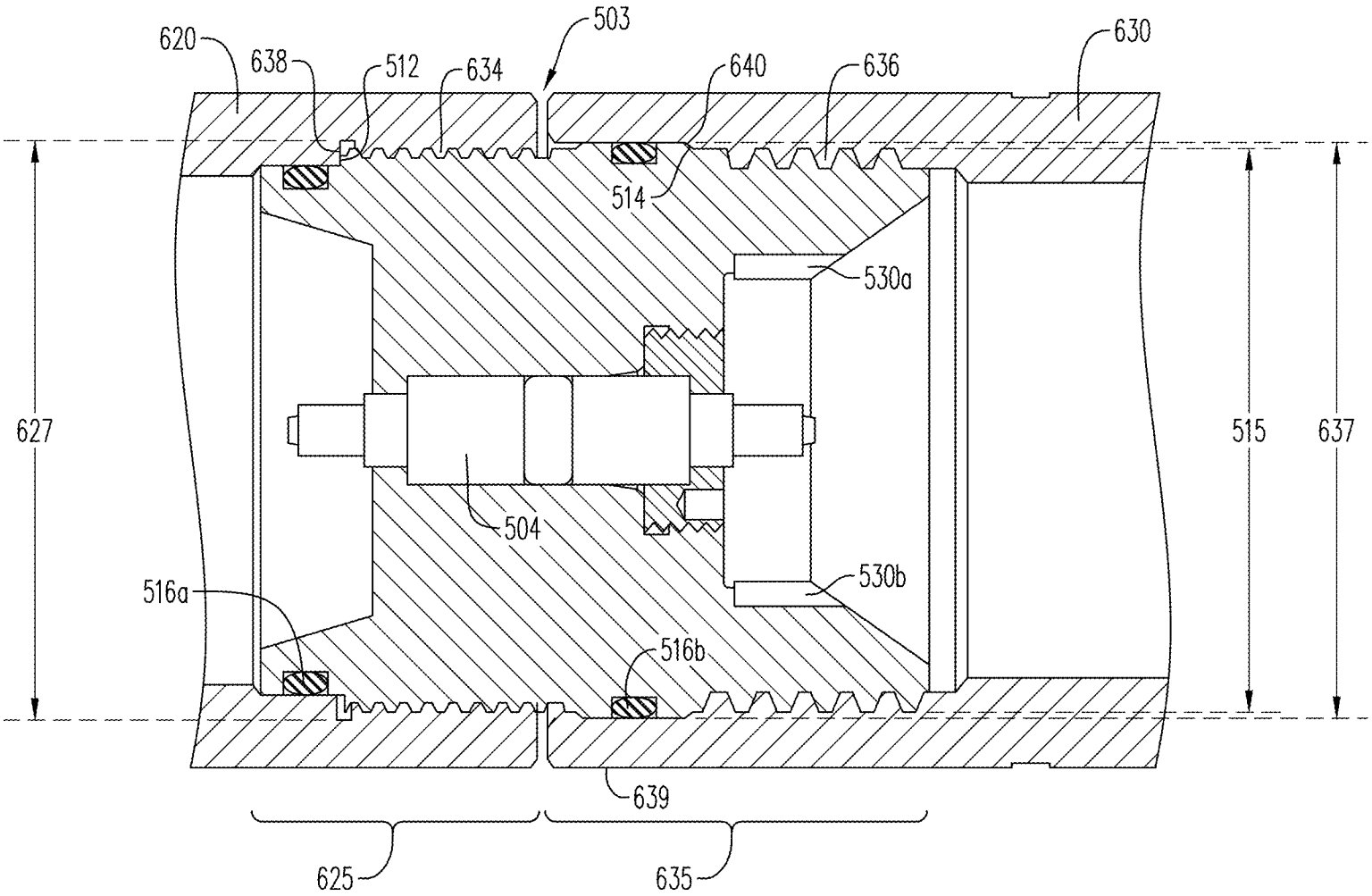
FIG. 6 is a longitudinal cross-sectional view of the tandem seal adapter of FIG. 5 coupled to a first wellbore tool and a second wellbore tool.

As shown in FIG. 6, the first sealing portion 505*a* may be configured to create a first seal with a first wellbore tool 620, the first threaded portion 510*a* may be configured to engage a first screw thread of the first wellbore tool 620, the second sealing portion 505*b* may be configured to create a second seal with a second wellbore tool 630 (e.g., via lip 639), and the second threaded portion 510*b* may be configured to engage a second screw thread of the second wellbore tool 630. In various embodiments, the first wellbore tool 620 may be the same or similar to the first wellbore tool 20.

Each of the first and second sealing portions 505*a*, 505*b* of the body portion 502 have a non-threaded (e.g., devoid of a screw thread) outer sealing surface in which an annular recess is defined. The annular recess accommodates a respective seal 516*a*, 516*b* (e.g., an O-ring or elastomeric component) configured to prevent wellbore fluids from passing axially between an inner surface of the first wellbore tool 620 and the second wellbore tool 630 and the outer surface 508 of the body portion 502. Thus, in various embodiments, at least a portion of the seal 516*a* may be disposed in the annular recess of the first sealing portion 505*a* (which may be the same or similar to the first end portion 102*a* of TSA 100) and at least a portion of the seal 516*b* may be disposed in the annular recess of the second sealing portion 505*b*. In many embodiments, the diameter of the annular recess of the first sealing portion 505*a* may be less than the diameter of the annular recess of the second sealing portion 505*b*.

The first threaded portion 510*a* and the second threaded portion 510*b* may have different thread characteristics (e.g., major diameter, minor diameter, pitch, thread angle, and the like). The first threaded portion 510*a* may be configured to threadedly couple to a corresponding threaded inner surface 634 of the first wellbore tool 620, and the second threaded portion 510*b* may be configured to threadedly couple to a corresponding threaded inner surface 636 of the second wellbore tool 630.

The outer surface 508 of the body portion 502 may include a first shoulder or stepped portion 512 that connects the first threaded portion 510*a* to the first sealing portion 505*a*. Additionally, in contrast to TSA 100, the outer surface 508 of the body portion 502 of TSA 500 may include a second shoulder or stepped portion 514 that connects the second sealing portion 505*b* to the second threaded section 510*b*. The first stepped portion 512 is configured to abut a corresponding first shoulder 638 of the first wellbore tool 620, and the second stepped portion 514 is configured to abut a corresponding second shoulder 640 of the second wellbore tool 630 when the first and second wellbore tools 620, 630 are secured to the TSA 500. Therefore, the stepped portions 512, 514 of the tandem seal adapter 500 may indicate to an operator that the wellbore tools 620, 630 are properly secured to the tandem seal adapter 500.

More generally, the first wellbore tool 620 may include a mating portion 625 configured to engage with the TSA 500 when the first wellbore tool 620 is coupled to the TSA 500. Accordingly, the mating portion 625 of the first wellbore tool 620 may include the threaded inner surface 634 and the shoulder 638. Further, the mating portion 625 of the first wellbore tool 620 includes a maximum inner diameter 627 that is greater than a maximum outer diameter 515 of the TSA 500. The second wellbore tool 630 includes a mating portion 635 configured to engage with the TSA 500 when the second wellbore tool 630 is coupled to the TSA 500. The mating portion 635 of the second wellbore tool 630 may include the lip 639, the shoulder 640, and the threaded inner surface 636. Further, the mating portion 635 of the second wellbore tool 630 includes a maximum inner diameter 637 that is greater than the maximum outer diameter 515 of the TSA 500.

As shown in FIG. 6, the first wellbore tool 620 may couple to TSA 500 in the same manner as the first wellbore tool 20 couples to TSA 100. However, as illustrated in FIG. 6, the second wellbore tool 630 may couple to TSA 500 in a different manner in which a lip 639 adjacent an end of the second wellbore tool 630 seals with the second sealing portion 505*b* of TSA 500 and the threaded inner surface 636 adjacent to and inward of the lip 639 of the second wellbore tool 630. In other words, the mating portion 625 of wellbore tool 620 may include the threaded inner surface 634 closer to the end than the sealing surface and the mating portion 635 of wellbore tool 630 may include the sealing surface closer to the end than the threaded inner surface 636.

Referring back to FIG. 5, the body portion 502 may define a bore 518 therethrough in which the bulkhead 504 is supported. The bore 518 may extend along a central longitudinal axis "x-x" of the body portion 502 or may be offset from the central longitudinal axis "x-x." The bore 518 may allow for a signal transfer, like an electrical feedthrough or a ballistic transfer, through the tandem seal adapter 500. The ballistic transfer may be an explosive booster or a detonating cord, or a combination of both, for transferring the ballistic signal received from the first wellbore tool 620 to the second wellbore tool 630. In aspects, the feedthrough hosted within the bore 118 may be the conductive bulkhead 504 that maintains sealing between the interiors of the first wellbore tool 620 and the second wellbore tool 630.

To this end, the bulkhead 504 may include a first pin 532*a* and a second pin 532*b* configured to establish electrical contact with a first wellbore tool and a second wellbore tool, respectively. In various embodiments, the first and second pins 532*a*, 532*b* may be biased, such as via a spring. In various such embodiments, the first and second pins 532*a*, 532*b* may be at least partially depressed into the bulkhead 504 when brought into contact with first and second wellbore tools, respectively (see e.g., FIG. 6). Biasing of the first and second pins 532*a*, 532*b* may ensure reliable contact between the bulkhead 504 and first and second wellbore tools 620, 630. In many embodiments, contact between the bulkhead 504 and first and second wellbore tools may be utilized to pass electrical signals between the first and second wellbore tools. Accordingly, the bulkhead may be configured to communicatively couple the first wellbore tool 620 and the second wellbore tool 630. For example, electronic communication signals may be passed between the first wellbore tool 620 and the second wellbore tool 630 via the bulkhead 504 Additionally, the bulkhead 504 may include a seal 534 configured to prevent or resist pressure changes from propagating through the bore 518. Accordingly, the bulkhead 504 may be utilized, at least in part, to maintain pressure isolation between the first wellbore tool 620 and the second wellbore tool 630.

The bore 518 of the body portion 502 has a conical end portion 520 at end 502*b*, a first cylindrical portion 522 extending axially from the conical end portion 520 toward a center of the body portion 502, and a second cylindrical portion 524 extending axially from the first cylindrical portion 522. The second cylindrical portion 524 may have a smaller diameter than the first cylindrical portion 522 and be configured for receipt of the retainer nut 506 that secures the bulkhead 504 in the bore 518. The bore 518 further includes a main portion 526 extending axially between the first end 502*a* of the body portion 502 and the second cylindrical portion 524. The main portion 526 may have a smaller diameter than the second cylindrical portion 524 and be configured to accommodate the bulkhead 504 therein. In various embodiments, the bore 518 may further include an end portion 528 extending axially between the main portion 526 and a conical end portion 521 at end 502*a* of the body portion 502. The end portion 528 may have a smaller diameter than the main portion 526 and prevent the bulkhead 504 from moving away from the conical end portion 520 when the bulkhead 504 is secured in the bore 518.

The second end 502*b* of the body portion 502 may define a pair of opposed recesses or keyways 530*a*, 530*b* that extend radially outward from the conical end portion 520 of the bore 518. As discussed in more detail below, the keyways 530*a*, 530*b* may have a semicircular shape corresponding to a pair of respective keys 42 on a power tool, such as, for example, a hand-operated rotary power tool 46 (see e.g., FIG. 9). In aspects, the keyways 530*a*, 530*b* and the keys 42 may assume any suitable shape. It will be appreciated that the configuration of the second end 502*b* of TSA 500 may be the same or similar to the second end 102*b* of TSA 100 such that FIGS. 7 and 8 corresponds to TSA 100 and TSA 500.

Figure 10:
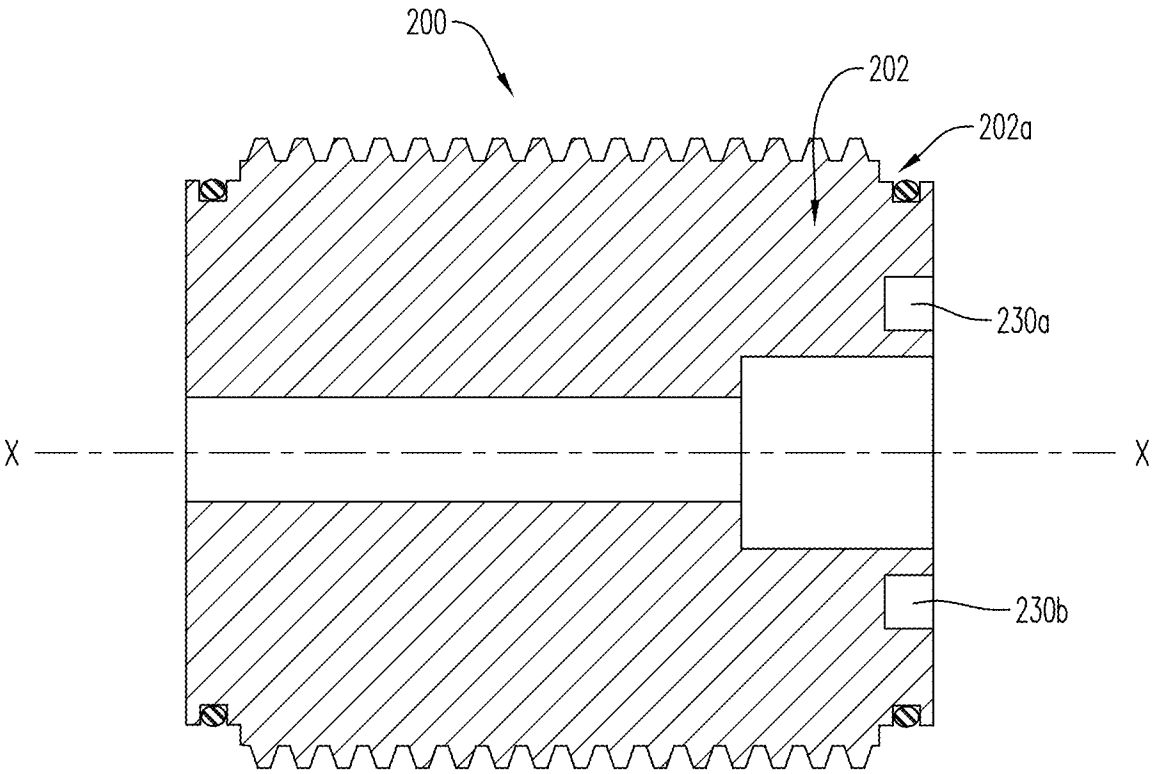
FIG. 10 is a longitudinal cross-sectional view illustrating another exemplary embodiment of a tandem seal adapter.
Figure 11:
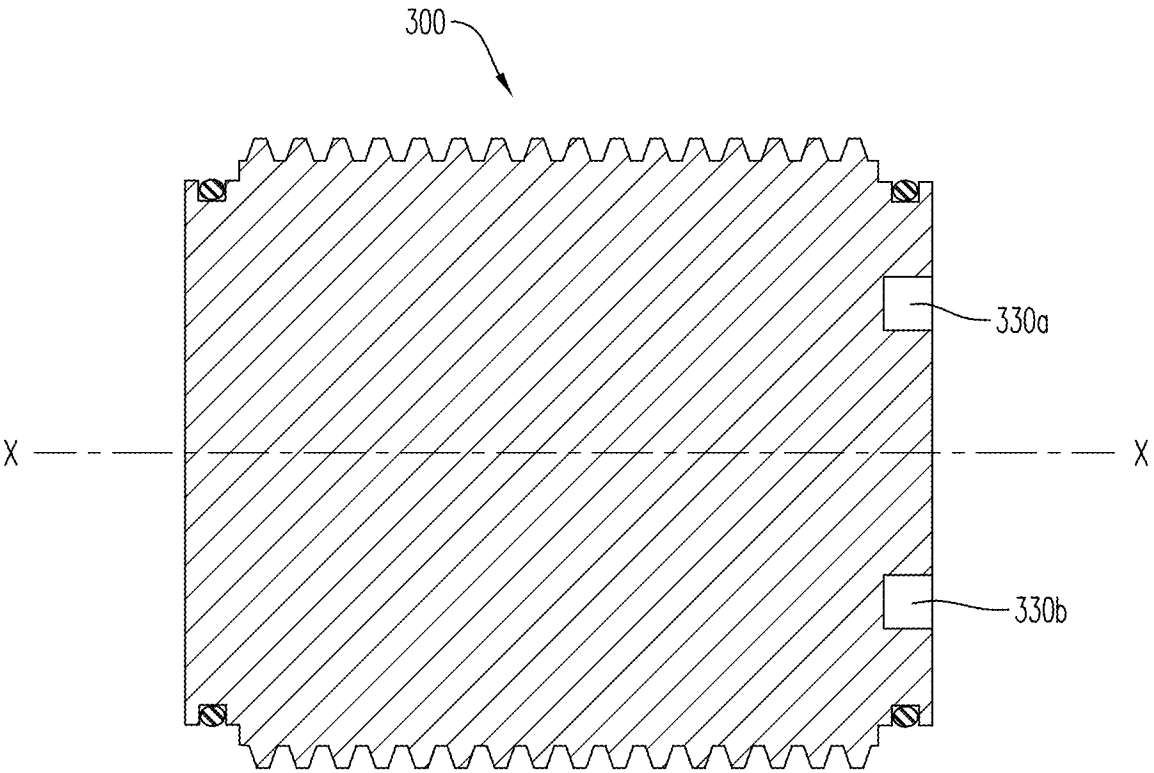
FIG. 11 is a longitudinal cross-sectional view illustrating another exemplary embodiment of a tandem seal adapter.
Figure 12B:
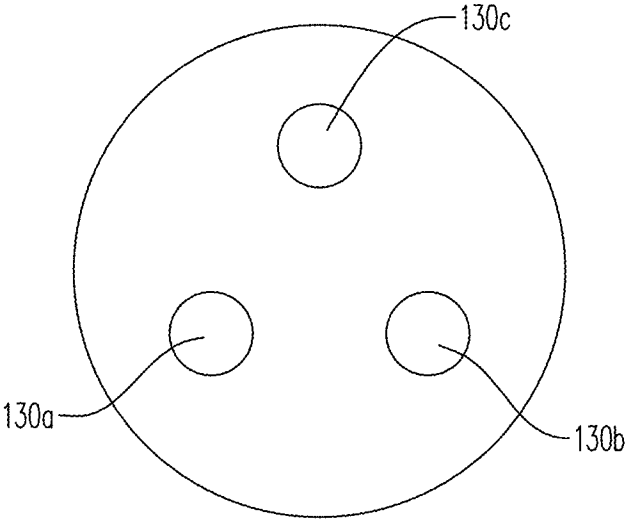
FIG. 12*b* is a schematic, end view illustrating yet another embodiment of a tandem seal adapter.
Figure 12A:
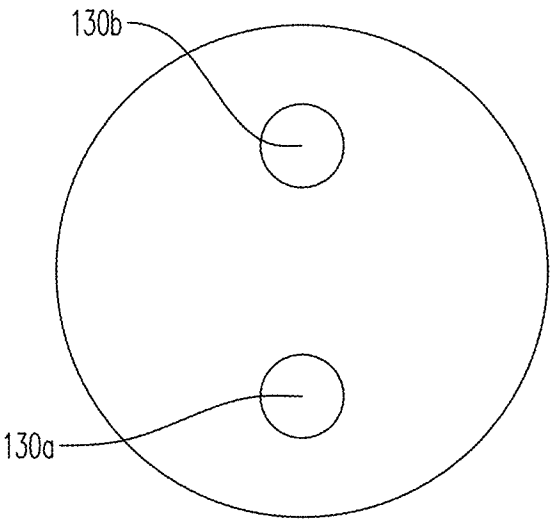
FIG. 12*a* is a schematic, end view illustrating another exemplary embodiment of a tandem seal adapter.

In another embodiment, as shown in FIG. 10, keyways 230*a*, 230*b* may be defined in an end surface 232 of a first end portion 202*a* of a body portion 202 of another embodiment of a tandem seal adapter 200. In aspects, the keyways 230*a*, 230*b* may assume a square shape. In another embodiment, as shown in FIG. 11, keyways 330*a*, 330*b* may be defined in an embodiment of a tandem seal adapter 300 that is devoid of a central bore defined therethrough. In yet further embodiments, as shown in FIGS. 12*a* and 12*b*, keyways 130*a*, 130*b* may assume a circular shape and may include two opposed keyways (FIG. 12*a*) or three keyways 130*a*, 130*b*, 130*c* (FIG. 12*b*) arranged in a triangular configuration. Other suitable numbers of keyways, shapes and configurations thereof are also contemplated.

Figure 3:
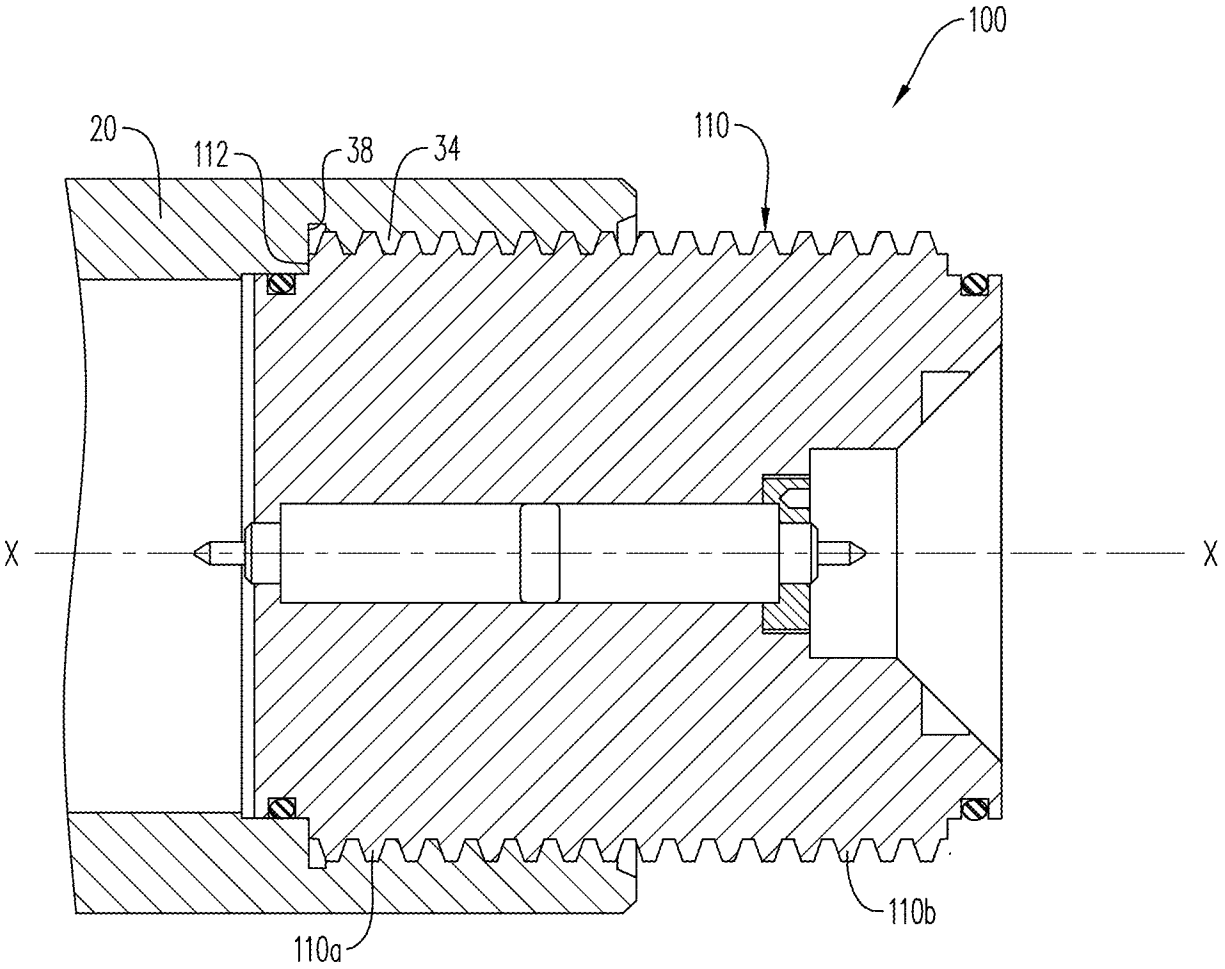
FIG. 3 is a longitudinal cross-sectional view of the tandem seal adapter of FIG. 2 coupled to a first wellbore tool.

With reference to FIGS. 3 and 4, a method of assembling the first wellbore tool 20 and the second wellbore tool 30 utilizing the tandem seal adapter 100 of the present disclosure will now be described. First, the first wellbore tool 20 may be positioned over the first end portion 110*a* of the screw thread 110 of the tandem seal adapter 100, followed by positioning the keys 42 of the power tool 46 (FIG. 9) into the corresponding keyways 130*a*, 130*b* of the body portion 102 of the tandem seal adapter 100. With the keys 42 of the power tool 46 positioned in the corresponding keyways 130*a*, 130*b* and while a user restricts rotation of the first wellbore tool 20 by, for example, grasping the first wellbore tool 20, the power tool 46 may be actuated. Upon actuation, the tandem seal adapter 100 rotates about the central longitudinal axis "x-x" relative to the first wellbore tool 20. As the tandem seal adapter 100 is rotated by the power tool 46, the first wellbore tool 20 moves axially along the outer surface 108 of the tandem seal adapter 100 due to the threaded engagement between the first end portion 110*a* of the screw thread 110 of the tandem seal adapter 100 and the threaded inner surface 34 of the first wellbore tool 20. Rotation of the tandem seal adapter 100 is continued until the first stepped portion 112 of the tandem seal adapter 100 abuts the corresponding first shoulder 38 of the first wellbore tool 20, as shown in FIG. 3.

With the first wellbore tool 20 attached to the tandem seal adapter 100, the second wellbore tool 30 may be positioned over the second end portion 110*b* of the screw thread 110 of the tandem seal adapter 100. While a user restricts rotation of the second wellbore tool 30 by, for example, grasping the second wellbore tool 30, the power tool 46 may be actuated whereby the tandem seal adapter 100 and the attached first wellbore tool 20 rotate together about the central longitudinal axis "x-x" relative to the second wellbore tool 30. Additionally, or alternatively, the first wellbore tool 20 attached to the tandem seal adapter 100 may be grasped while the second wellbore tool 30 is rotated. In some such embodiments, the rotary tool 46 may be coupled to other keyways (e.g., of another TSA coupled to the opposite end of the second wellbore tool 30. In one embodiment, as the tandem seal adapter 100 is rotated, such as by the power tool 46, the second wellbore tool 30 moves axially along the outer surface 108 of the tandem seal adapter 100 due to the threaded engagement between the second end portion 110*b* of the screw thread 110 of the tandem seal adapter 100 and the threaded inner surface 36 of the second wellbore tool 30. In some embodiments, the first or second wellbore tool 20, 30 may be rotated by hand and/or a body of the first or second wellbore tool 20, 30 may include features for using a tool to rotate it. For example, the body of the second wellbore tool 30 may include opposing flat portions that a box wrench can engage with. Rotation of the tandem seal adapter 100 is continued until the second stepped portion 114 of the tandem seal adapter 100 abuts the corresponding second shoulder 40 of the second wellbore tool 30, as shown in FIG. 4. In some embodiments, the first and second wellbore tools 20, 30 may be communicatively coupled by bringing a first end of the bulkhead into contact with a portion of the first wellbore tool 20 and a second end of the bulkhead into contact with a portion of the second wellbore tool 30, such as through the rotations described above. In some such embodiments, bringing the ends of the bulkhead into contact with the portions of the first and second wellbore tools may at least partially depress the biased pins extending from the first and second ends of the bulkhead.

In various embodiments, distal tips of the first and second wellbore tools 20, 30 define an axial gap 103 (FIG. 1) therebetween when the first and second wellbore tools 20, 30 are suitably tightened to the tandem seal adapter 100. The axial gap 103 may be about 1 mm or less. In various embodiments, a seal is created between the tandem seal adapter 100, the first wellbore tool 20, and the second wellbore tool 30. For example, a seal (e.g., an O-ring or elastomeric component) may be positioned within the axial gap 103. In other aspects, the distal tips of the first and second wellbore tools 20, 30 may abut one another upon the first and second wellbore tools 20, 30 being suitably tightened to the tandem seal adapter 100 without the distal tips functioning as a frictional/torque interface.

With reference to FIGS. 5 and 6, a method of assembling the first wellbore tool 620 and the second wellbore tool 630 utilizing the tandem seal adapter 500 of the present disclosure will now be described. First, the first wellbore tool 620 may be positioned over the first sealing portion 505*a* of the tandem seal adapter 500, followed by positioning the keys 42 of the power tool 46 (FIG. 9) into the corresponding keyways 530*a*, 530*b* of the body portion 502 of the tandem seal adapter 500. With the keys 42 of the power tool 46 positioned in the corresponding keyways 530*a*, 530*b* and while a user restricts rotation of the first wellbore tool 620 by, for example, grasping the first wellbore tool 620, the power tool 46 may be actuated. Upon actuation, the tandem seal adapter 500 rotates about the central longitudinal axis "x-x" relative to the first wellbore tool 620. As the tandem seal adapter 500 is rotated by the power tool 46, the first wellbore tool 620 moves axially along the outer surface 508 of the tandem seal adapter 500 due to the threaded engagement between the threaded portion 510*a* and the threaded inner surface 634 of the first wellbore tool 620. Rotation of the tandem seal adapter 500 is continued until the first stepped portion 512 of the tandem seal adapter 500 abuts the corresponding first shoulder 638 of the first wellbore tool 620, as shown in FIG. 6.

With the first wellbore tool 620 attached to the tandem seal adapter 500, the second wellbore tool 630 may be positioned over the second end 502*b* of the tandem seal adapter 500. While a user restricts rotation of the second wellbore tool 630 by, for example, grasping the second wellbore tool 630, the power tool 46 may be actuated whereby the tandem seal adapter 500 and the attached first wellbore tool 620 rotate together about the central longitudinal axis "x-x" relative to the second wellbore tool 630. Additionally, or alternatively, the first wellbore tool 620 attached to the tandem seal adapter 500 may be grasped while the second wellbore tool 630 is rotated. In some such embodiments, the rotary tool 46 may be coupled to other keyways (e.g., of another TSA coupled to the opposite end of the second wellbore tool 630. In one embodiment, as the tandem seal adapter 500 is rotated, such as by the power tool 46, the second wellbore tool 630 moves axially along the outer surface 508 of the tandem seal adapter 500 due to the threaded engagement between the second threaded portion 510*b* of the tandem seal adapter 500 and the threaded inner surface 636 of the second wellbore tool 630. In some embodiments, the first or second wellbore tool 620, 630 may be rotated by hand and/or a body of the first or second wellbore tool 620, 630 may include features for using a tool to rotate it. For example, the body of the second wellbore tool 30 may include opposing flat portions that a box wrench can engage with. Rotation of the tandem seal adapter 500 is continued until the second stepped portion 514 of the tandem seal adapter 500 abuts the corresponding second shoulder 640 of the second wellbore tool 630, as shown in FIG. 6. In some embodiments, the first and second wellbore tools 620, 630 may be communicatively coupled by bringing a first end of the bulkhead into contact with a portion of the first wellbore tool 620 and a second end of the bulkhead into contact with a portion of the second wellbore tool 630, such as through the rotations described above. In some such embodiments, bringing the ends of the bulkhead into contact with the portions of the first and second wellbore tools may at least partially depress the biased pins extending from the first and second ends of the bulkhead.

In various embodiments, distal tips of the first and second wellbore tools 620, 630 define an axial gap 503 (FIG. 5) therebetween when the first and second wellbore tools 620, 630 are suitably tightened to the tandem seal adapter 500. The axial gap 503 may be about 1 mm or less. In various embodiments, a seal is created between the tandem seal adapter 500, the first wellbore tool 620, and the second wellbore tool 630. For example, a seal (e.g., an O-ring or elastomeric component) may be positioned within the axial gap 503. In other aspects, the distal tips of the first and second wellbore tools 620, 630 may abut one another upon the first and second wellbore tools 620, 630 being suitably tightened to the tandem seal adapter 500 without the distal tips functioning as a frictional/torque interface.

This disclosure, in various embodiments, configurations and aspects, includes components, methods, processes, systems, and/or apparatuses as depicted and described herein, including various embodiments, sub-combinations, and subsets thereof. This disclosure contemplates, in various embodiments, configurations and aspects, the actual or optional use or inclusion of, e.g., components or processes as may be well-known or understood in the art and consistent with this disclosure though not depicted and/or described herein.

The phrases "at least one", "one or more", and "and/or" are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" means A alone, B alone, C alone, A and B together, A and C together, B and C together, or A, B and C together.

In this specification and the claims that follow, reference will be made to a number of terms that have the following meanings. The terms "a" (or "an") and "the" refer to one or more of that entity, thereby including plural referents unless the context clearly dictates otherwise. As such, the terms "a" (or "an"), "one or more" and "at least one" can be used interchangeably herein. Furthermore, references to "one embodiment", "some embodiments", "an embodiment" and the like are not intended to be interpreted as excluding the existence of additional embodiments that also incorporate the recited features. Approximating language, as used herein throughout the specification and claims, may be applied to modify any quantitative representation that could permissibly vary without resulting in a change in the basic function to which it is related. Accordingly, a value modified by a term such as "about" is not to be limited to the precise value specified. In some instances, the approximating language may correspond to the precision of an instrument for measuring the value. Terms such as "first," "second," "upper," "lower" etc. are used to identify one element from another, and unless otherwise specified are not meant to refer to a particular order or number of elements.

As used herein, the terms "may" and "may be" indicate a possibility of an occurrence within a set of circumstances; a possession of a specified property, characteristic or function; and/or qualify another verb by expressing one or more of an ability, capability, or possibility associated with the qualified verb. Accordingly, usage of "may" and "may be" indicates that a modified term is apparently appropriate, capable, or suitable for an indicated capacity, function, or usage, while taking into account that in some circumstances the modified term may sometimes not be appropriate, capable, or suitable. For example, in some circumstances an event or capacity can be expected, while in other circumstances the event or capacity cannot occur—this distinction is captured by the terms "may" and "may be."

As used in the claims, the word "comprises" and its grammatical variants logically also subtend and include phrases of varying and differing extent such as for example, but not limited thereto, "consisting essentially of" and "consisting of." Where necessary, ranges have been supplied, and those ranges are inclusive of all sub-ranges therebetween. It is to be expected that the appended claims should cover variations in the ranges except where this disclosure makes clear the use of a particular range in certain embodiments.

This disclosure is presented for purposes of illustration and description. This disclosure is not limited to the form or forms disclosed herein. In the Detailed Description of this disclosure, for example, various features of some exemplary embodiments are grouped together to representatively describe those and other contemplated embodiments, configurations, and aspects, to the extent that including in this disclosure a description of every potential embodiment, variant, and combination of features is not feasible. Thus, the features of the disclosed embodiments, configurations, and aspects may be combined in alternate embodiments, configurations, and aspects not expressly discussed above. For example, the features recited in the following claims lie in less than all features of a single disclosed embodiment, configuration, or aspect. Thus, the following claims are hereby incorporated into this Detailed Description, with each claim standing on its own as a separate embodiment of this disclosure.

Advances in science and technology may provide variations that are not necessarily express in the terminology of this disclosure although the claims would not necessarily exclude these variations.

What is claimed is:

1. A device for connecting a first wellbore tool comprising a perforating gun to a second wellbore tool, the device comprising:

a body portion including a first and second end, the body portion including an outer surface extending between the first end and the second end, the outer surface including:

a first sealing portion surrounding the outer surface and configured to create a first seal with the first wellbore tool, an external screw thread including a first threaded portion and a second threaded portion, the first threaded portion configured to engage a first internal screw thread of a first mating portion of the first wellbore tool and the second threaded portion configured to engage a second internal screw thread of a second mating portion of the second wellbore tool, and a second sealing portion surrounding the outer surface and configured to create a second seal with the second wellbore tool, wherein a maximum outer diameter of the body portion is less than a maximum inner diameter of the first mating portion of the first wellbore tool and the second mating portion of the second wellbore tool, and wherein the external screw thread extends uninterrupted between the first sealing portion and the second sealing portion.

2. The device of claim 1, wherein the first sealing portion includes a first annular recess with at least a portion of a first seal disposed in the first annular recess and the second sealing portion having a second annular recess with at least a portion of a second seal disposed in the second annular recess.

3. The device of claim 2, wherein at least one of the first seal and the second seal are configured to prevent wellbore fluids from passing axially between the outer surface of the body portion and an inner surface of at least one of the first wellbore tool and the second wellbore tool.

4. The device of claim 1, wherein the second wellbore tool includes a perforating gun.

5. The device of claim 1, further comprising a bore extending through the body portion from the first end to the second end.

6. The device of claim 5, wherein the bore includes a cylindrical main portion and a first cylindrical portion positioned between the cylindrical main portion and the second end of the body portion, the cylindrical main portion having a smaller diameter than the first cylindrical portion.

7. The device of claim 6, wherein the bore includes a second cylindrical portion positioned between the cylindrical main portion and the first cylindrical portion, the second cylindrical portion having a smaller diameter than the first cylindrical portion and a larger diameter than the cylindrical main portion.

8. The device of claim 5, wherein an electrical feedthrough or a ballistic transfer is disposed in the bore.

9. The device of claim 1, wherein the first threaded portion is configured to abut a first shoulder of the first mating portion of the first wellbore tool or the second threaded portion is configured to abut a second shoulder of the second mating portion of the second wellbore tool.

10. A perforating system for use in a wellbore environment, the perforating system comprising:

a first wellbore tool comprising a perforating gun, the first wellbore tool comprising a first mating portion with a first internal screw thread; and a tandem seal adapter (TSA) comprising:

a body portion including a first and second end, the body portion including an outer surface extending between the first end and the second end, the outer surface including:

an external screw thread including a first threaded portion and a second threaded portion, the first threaded portion threaded onto the first internal screw thread of the first mating portion of the first wellbore tool and the second threaded portion configured to engage a second internal screw thread of a second mating portion of a second wellbore tool, a first sealing portion surrounding the outer surface and creating a first seal with the first wellbore tool, a second sealing portion surrounding the outer surface and configured to create a second seal with the second wellbore tool, wherein the external screw thread extends uninterrupted between the first sealing portion and the second sealing portion, and wherein a maximum outer diameter of the body portion is less than a maximum inner diameter of the first mating portion of the first wellbore tool and the second mating portion of the second wellbore tool.

11. The perforating system of claim 10, wherein the first sealing portion includes a first annular recess with at least a portion of a first seal disposed in the first annular recess and the second sealing portion having a second annular recess with at least a portion of a second seal disposed in the second annular recess.

12. The perforating system of claim 10, wherein an outer surface of the first wellbore tool includes a first outer diameter, a second outer diameter less than the first outer diameter, and at least one portion of the outer surface that transitions from the first outer diameter to the second outer diameter and transitions back to the first outer diameter.

13. The perforating system of claim 12, wherein the first outer diameter comprises a maximum outer diameter of the outer surface of the first wellbore tool.

14. The perforating system of claim 10, further comprising a bore extending through the body portion of the TSA from the first end to the second end and an electrical feedthrough or a ballistic transfer disposed in the bore that is configured to transfer a signal between the first wellbore tool and the second wellbore tool.

15. The perforating system of claim 10, further comprising a bore extending through the body portion of the TSA from the first end to the second end, wherein the bore includes a cylindrical main portion, a first cylindrical portion, and a second cylindrical portion, the first cylindrical portion positioned between the cylindrical main portion and the second end of the body portion, the second cylindrical portion positioned between the cylindrical main portion and the first cylindrical portion, the cylindrical main portion having a smaller diameter than the first cylindrical portion, and the second cylindrical portion having a smaller diameter than the first cylindrical portion and a larger diameter than the cylindrical main portion.

16. The perforating system of claim 10, wherein the first threaded portion abuts a first shoulder of the first mating portion of the first wellbore tool.

17. A perforating system for use in a wellbore environment, the perforating system comprising:

a first perforating gun comprising a first mating portion with a first shoulder and a first internal screw thread;

a second perforating gun comprising a second mating portion with second shoulder and a second internal screw thread; and a tandem seal adapter (TSA) comprising:

a body portion including a first and second end, the body portion including an outer surface extending between the first end and the second end, the outer surface including:

an external screw thread including a first threaded portion and a second threaded portion, the first threaded portion threaded onto the first internal screw thread of the first mating portion of the first perforating gun and the first shoulder of the first perforating gun abuts the TSA, and the second threaded portion threaded onto the second internal screw thread of the second mating portion of the second perforating gun and the second shoulder of the second perforating gun abuts the TSA, a first sealing portion surrounding the outer surface and creating a first seal with the first perforating gun, a second sealing portion surrounding the outer surface and configured to create a second seal with the second perforating gun, wherein the external screw thread extends uninterrupted between the first sealing portion and the second sealing portion, and wherein a maximum outer diameter of the body portion is less than a maximum inner diameter of the first mating portion of the first perforating gun and the second mating portion of the second perforating gun.

18. The perforating system of claim 17, further comprising a bore extending through the body portion of the TSA from the first end to the second end and an electrical feedthrough or a ballistic transfer disposed in the bore that is configured to transfer a signal between the first perforating gun and the second perforating gun.

19. The perforating system of claim 17, further comprising a bore extending through the body portion of the TSA from the first end to the second end, wherein the bore includes a cylindrical main portion, a first cylindrical portion, and a second cylindrical portion, the first cylindrical portion positioned between the cylindrical main portion and the second end of the body portion, the second cylindrical portion positioned between the cylindrical main portion and the first cylindrical portion, the cylindrical main portion having a smaller diameter than the first cylindrical portion, and the second cylindrical portion having a smaller diameter than the first cylindrical portion and a larger diameter than the cylindrical main portion.

20. The perforating system of claim 17, further comprising an axial gap between a first distal tip of the first perforating gun and a second distal tip of the second perforating gun.

* * * * *